US008899612B2

(12) United States Patent
Yelovina

(10) Patent No.: US 8,899,612 B2
(45) Date of Patent: Dec. 2, 2014

(54) SPORTS ARTICLE WITH A GUIDE ELEMENT FOR FOOTWEAR

(75) Inventor: Eddy Yelovina, Epagny (FR)

(73) Assignee: Saloman S.A.S., Metz-Tessy (FR)

( * ) Notice: Subject to any disclaimer, the term of this patent is extended or adjusted under 35 U.S.C. 154(b) by 147 days.

(21) Appl. No.: 13/307,736

(22) Filed: Nov. 30, 2011

(65) Prior Publication Data

US 2012/0153599 A1 Jun. 21, 2012

(30) Foreign Application Priority Data

Dec. 17, 2010 (FR) ..... 10 04928

(51) Int. Cl.
*A63C 9/00* (2012.01)
*A63C 9/20* (2012.01)

(52) U.S. Cl.
CPC ..... *A63C 9/20* (2013.01)
USPC ..... 280/636; 280/615

(58) Field of Classification Search
CPC ..... A63C 9/00; A63C 9/20
USPC ..... 280/607, 609, 611, 613, 617, 618, 615, 280/636, 614, 633, 634, 631, 632, 637, 626, 280/628, 629, 14.24
See application file for complete search history.

(56) References Cited

U.S. PATENT DOCUMENTS

| | | | | |
|---|---|---|---|---|
| 4,082,312 | A * | 4/1978 | Johnson | 280/615 |
| 4,312,141 | A * | 1/1982 | Mayer et al. | 36/117.2 |
| 4,487,427 | A * | 12/1984 | Salomon | 280/615 |
| 4,772,041 | A * | 9/1988 | Klosterman | 280/611 |
| 5,088,756 | A | 2/1992 | Hue et al. | |
| 5,088,757 | A | 2/1992 | Hauglin | |
| 5,090,723 | A | 2/1992 | Arnulf | |
| 5,664,797 | A * | 9/1997 | Haughlin | 280/615 |
| 6,450,511 | B1 * | 9/2002 | LaVoy | 280/14.22 |
| 7,281,717 | B2 * | 10/2007 | Sacco et al. | 280/14.22 |
| 7,644,947 | B2 * | 1/2010 | Girard et al. | 280/615 |
| D627,846 | S * | 11/2010 | Girard et al. | D21/773 |
| 7,828,303 | B2 * | 11/2010 | Girard et al. | 280/11.3 |
| 7,909,352 | B2 * | 3/2011 | Girard et al. | 280/612 |
| 7,967,324 | B2 * | 6/2011 | Miette et al. | 280/618 |
| 8,201,845 | B2 * | 6/2012 | Girard et al. | 280/617 |
| 2002/0140208 | A1 * | 10/2002 | Duvall | 280/624 |

(Continued)

FOREIGN PATENT DOCUMENTS

| | | | |
|---|---|---|---|
| DE | 39 29 352 | A1 | 3/1991 |
| FR | 2 623 094 | A1 | 5/1989 |
| FR | 2 652 754 | A1 | 4/1991 |
| WO | WO-82/03559 | A1 | 10/1982 |

*Primary Examiner* — Hau Phan
*Assistant Examiner* — Jacob Meyer
(74) *Attorney, Agent, or Firm* — Greenblum & Bernstein, P.L.C.

(57) ABSTRACT

A sports article is adapted to cooperate with a boot, including a sports apparatus and a lateral guide element for the rear portion of the boot. The sports apparatus includes at least one positioning mechanism. The lateral guide element includes at least one complementary positioning mechanism cooperating with the associated positioning mechanism(s) of the sports apparatus in order to adjust the position of the lateral guide element on the sports apparatus. The complementary positioning mechanism(s) is/are arranged so as to enable a longitudinal positioning of the lateral guide element on the sports apparatus at two different lengthwise positions by cooperating with the same associated positioning mechanism(s), the second longitudinal position of the lateral guide element including a 180° rotation of the lateral guide element about an axis of rotation perpendicular to the top surface of the sports apparatus with respect to the first longitudinal position of the lateral guide element.

17 Claims, 5 Drawing Sheets

(56) References Cited

U.S. PATENT DOCUMENTS

| | | | | |
|---|---|---|---|---|
| 2003/0057679 | A1* | 3/2003 | Pollmiller | 280/611 |
| 2003/0178812 | A1* | 9/2003 | Schaller et al. | 280/618 |
| 2003/0230870 | A1* | 12/2003 | Sabol | 280/618 |
| 2004/0056451 | A1* | 3/2004 | Baikhardt | 280/618 |
| 2006/0012151 | A1* | 1/2006 | Girard et al. | 280/615 |
| 2007/0138765 | A1* | 6/2007 | Miette et al. | 280/615 |
| 2007/0273127 | A1* | 11/2007 | Girard et al. | 280/607 |
| 2008/0150256 | A1* | 6/2008 | Girard et al. | 280/612 |
| 2008/0191450 | A1* | 8/2008 | Girard et al. | 280/617 |
| 2009/0250905 | A1* | 10/2009 | Girard et al. | 280/607 |
| 2010/0313448 | A1* | 12/2010 | Girard et al. | 36/117.3 |
| 2010/0314854 | A1* | 12/2010 | Girard et al. | 280/607 |

* cited by examiner

SPORTS ARTICLE WITH A GUIDE ELEMENT FOR FOOTWEAR

CROSS-REFERENCE TO RELATED APPLICATION

This application is based upon French patent application Ser. No. 10/04928, filed Dec. 17, 2010, the disclosure of which is hereby incorporated by reference thereto in its entirety, and the priority of which is claimed under 35 U.S.C. §119.

BACKGROUND

1. Field of the Invention

The present invention relates to a sports article adapted to cooperate with footwear, such as a boot. The sports article includes a sports apparatus and a lateral guide element for the rear portion of the boot. A sports apparatus of this type can be a cross-country ski, a snowshoe, an alpine ski for ski touring or telemark skiing.

2. Background Information

To ensure good lateral support of a boot relative to a sports apparatus to which it is connected, a solution has been known to affix a lateral guide element to the top surface of the sports apparatus. Such a guide element includes at least one rib adapted to cooperate with a groove extending along the bottom surface of the boot sole when the boot is supported on the sports apparatus, that is to say, when the sole is parallel to the top surface of the sports apparatus. It is important that the rear portion of the boot be guided in order to provide more effective lateral support. To this end, the lateral guide element must be positioned so that the groove in the sole cooperates with the rib of the lateral guide element in the area of the heel. Beyond this zone, guiding is not necessary. Extending the rib beyond the heel, merely adds mass that weighs down the sports apparatus, which can disturb the balance of the sports apparatus. For this reason, adjusting the longitudinal position of the lateral guiding element as a function of boot size is desirable.

Historically, lateral guide elements are affixed to the top surface of the ski using nails or screws penetrating the core of the ski. To position these guide elements, the assembler uses a boot size-specific template. Therefore, the assembler must have as many templates as boot sizes to be able to adjust the position of the lateral guide element relative to the various boot sizes. Once the lateral guide element has been assembled, it is no longer possible to change the longitudinal position of the element without drilling into the sports apparatus once again, at the risk of weakening it. Moreover, it is not possible to adjust the longitudinal position of the lateral guide element even slightly. Indeed, the proximity of the attachment holes, fore or aft of the adjustment, can weaken the grip of the lateral guide element on the sports apparatus.

To overcome this problem, certain ski binding manufacturers have designed longitudinally adjustable lateral guide elements.

For example, patent document FR 2 623 094 and related document U.S. Pat. No. 5,088,756 disclose a lateral guide apparatus including a rib, the rear end of which is comprised of dividable sections enabling the length of the rib to be adjusted. Consequently, the length of the guiding rib can be adjusted so as to end in the area of the heel of the boot. To make a lateral guide element compatible with a plurality of boot sizes, it must be made as long as the largest boot size. This leads to the use of a lateral guide element that is longer than necessary for guiding the boot and therefore more costly to manufacture. Moreover, the design is a compromise between the rigidity of the rib, necessary for good lateral support, and the fragility necessary to enable the unnecessary dividable sections to be easily cut out. This compromise naturally brings about disadvantages inherent in the choice preferred.

SUMMARY

The invention provides an improved sports article.

In particular, the invention improves upon the effectiveness of the lateral guiding of a boot, by avoiding the aforementioned drawbacks.

Further, the invention provides for two distinct adjustments of a lateral guide element with the same positioning mechanism.

Still further, the invention reconciles both the adjustment and the performance of the sports apparatus. More particularly in this regard, the invention relates to a lateral guide element that minimally affects the properties of the sports apparatus, such as, in particular, its weight, flexibility, and balance.

The invention provides a sports article constructed and arranged to cooperate with a boot, including a sport apparatus and a lateral guide element for the rear portion of the boot. The sports apparatus includes at least one positioning mechanism. The lateral guide element includes at least one complementary positioning mechanism cooperating with the associated positioning mechanism(s) of the sports apparatus in order to adjust the position of the lateral guide element on the sports apparatus. The complementary positioning mechanism(s) is/are arranged so as to enable a double longitudinal positioning of the lateral guide element on the sports apparatus by cooperating with the same associated positioning mechanism(s), the second longitudinal positioning of the lateral guide element including a 180° rotation of the lateral guide element relative to an axis of rotation perpendicular to the top surface of the sports apparatus with respect to the first longitudinal positioning of the lateral guide element.

In the context of the invention, the "longitudinal positioning" or "longitudinal position" of the lateral guide element refers to the lateral guide element being positioned at a predetermined location on the top surface of the sports apparatus along a longitudinal axis of the sports apparatus. Associated with a device for retaining the boot, i.e., such as a binding for the boot, the longitudinal position of the lateral guide element enables the end of the guiding zone of the lateral guide element to be aligned with the heel of the boot, with the boot being supported on the sports apparatus. In most cases, the lateral guiding is achieved through cooperation of a longitudinal rib forming the lateral guide element with a complementary groove extending along the bottom surface of the boot sole. However, the guiding is effective only on a portion of the rib, referred to as the effective guiding length. This effective length corresponds to the portion of the rib for which the height of the rib is sufficient to cooperate effectively with the groove in the sole of the boot in order to obtain lateral support.

According to the invention, two longitudinal positions of the lateral guide element can easily be adjusted using the same positioning mechanisms of the sports apparatus that are coupled to the same complementary positioning mechanisms of the lateral guide element. The assembler obtains two possible adjustments of the guide element without having to use additional positioning mechanisms. For example, using a single template, the assembler can obtain and/or position the positioning mechanisms on the sports apparatus, such as two centering holes, which make it possible to adjust the position of the lateral guide element for two boot sizes. In addition, it is easier to reproduce the same adjustment from one sports apparatus to the next.

By providing for only two longitudinal positions for predetermined positioning mechanisms of the sports apparatus, the size of the lateral guide element can be optimized. Thus, the lateral guide element can be compact.

In a particular non-limiting embodiment, the lateral guide element has a single central guiding rib, which allows the rib to be sized so as to be more rigid, or even higher, depending upon the location available on the sports apparatus in this area.

To reduce the number of elements used, the positioning mechanism and/or the complementary positioning mechanism also make it possible to affix the lateral guide element to the sports apparatus.

The invention allows the use of simple positioning mechanisms, such as screws screwed directly onto the sports apparatus. In this example, the complementary positioning mechanisms are holes extending through the lateral guide element. The template would then make it possible to drill the holes for centering the screws in the sports apparatus.

To avoid the use of tools, the complementary positioning mechanism can be a projecting shape or a housing forming the end of an elastic lug, and the associated positioning mechanism can be a housing or a projecting shape capable of cooperating with the end the elastic lug.

To increase the number of possible adjustments with the same sports apparatus, a plurality of positioning mechanisms can be provided on the sports apparatus. Compared to the prior art, the number of indexations can be halved for the same adjustment range, due to the configurations corresponding to the reversal of the lateral guide element.

To make the guide element more compact, the complementary positioning mechanism can be arranged longitudinally between the two longitudinal ends of a lateral zone of the lateral guide element for guiding the rear portion of the boot.

To facilitate the assembly of the lateral guide element, a baseplate can be positioned between the lateral guide element and the sports apparatus. The complementary mechanism is then affixed to the baseplate attached on the sports apparatus.

The lateral guide element can be a unitary element, i.e., a single piece element, affixed directly to the sports apparatus and independent of the device for retaining the boot, or binding, which itself is affixed to the sports apparatus. The lateral guide element and the binding are thus compact as they are short in length. Therefore, these elements can easily be affixed to the top surface of a sports apparatus, which can be slightly cambered. The assembly of these elements on the sports apparatus can only slightly, if at all, deform the sports apparatus.

The invention also relates to a boot binding adapted to be affixed on a sports apparatus including a lateral guide element, as described hereinabove.

The invention also relates to a simple lateral guide element adapted to cooperate with the binding described hereinabove.

BRIEF DESCRIPTION OF DRAWINGS

The invention will be better understood and other advantages thereof will appear more clearly from the following description, given by way of examples, with reference to the annexed drawings, in which.

DETAILED DESCRIPTION

Although the embodiments described hereinafter relate to a sports article intended for cross-country skiing, it should be understood that they also apply to sports articles intended for other fields, as mentioned above.

The first embodiment is illustrated with reference to FIGS. 1 to 3.

Figure 1:
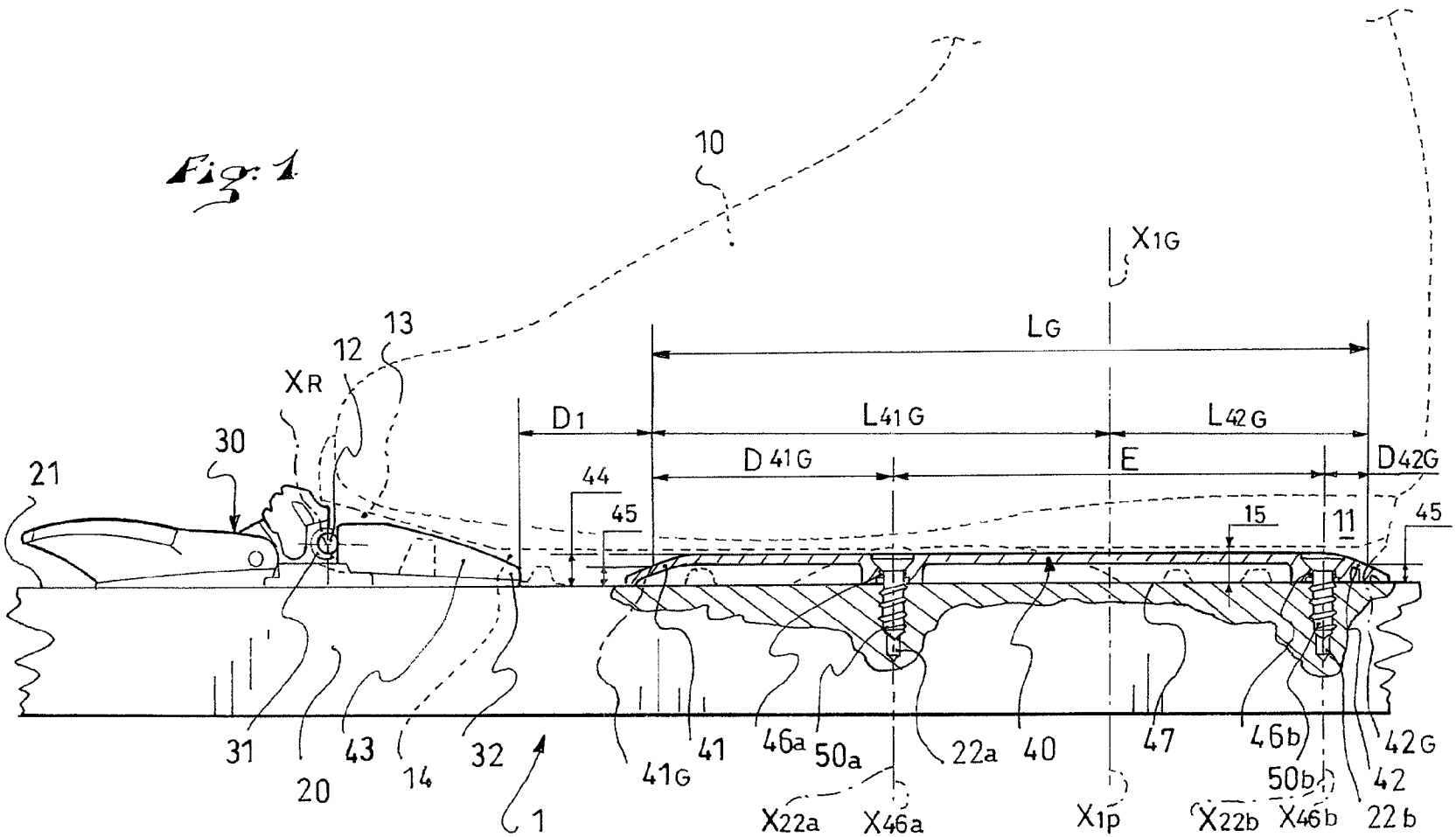
FIG. 1 is a partial vertical and longitudinal cross-section of a sports article according to a first embodiment of the invention.

FIG. 1 shows a sports article 1 comprising a sports apparatus 20, or board, in the form of a cross-country ski, the ski being structured and arranged to cooperate with a cross-country ski boot 10, the boot being shown in broken lines. The sports board 20, only a longitudinally extending central portion of which is illustrated for an understanding of the invention, is shown to be equipped with a device 30, i.e., a binding, for retaining the boot 10 and a lateral guide element 40 having a first end 41 and a second end 42. The retaining device and the lateral guide element are affixed to a top surface 21 of the board 20. The retaining device 30 can be any of various types, such as that disclosed in U.S. Patent Application Publication No. 2012/0126510, published May 24, 2012, the disclosure of which is hereby incorporated by reference thereto in its entirety.

In the case in which the lateral guide element is assembled on the ski shown in FIG. 1, the first end 41 is the front end of the guide element, the end closest to the retaining device, whereas the second end 42 is the rear end, the end arranged to face the heel 11 of the boot.

The boot can pivot about an axis XR transverse to the ski, due to the cooperation of a connecting bar 12 affixed to the front portion of the sole 13 of the boot with a jaw 31 of the retaining device.

As shown in FIG. 1, the boot can take support directly on the board, or via an intermediate element such as the retaining device. In this position, it is important for the boot to be supported laterally. To this end, in the example shown, the sole includes a groove 14 having a variable depth 15. The lateral support is obtained through cooperation of this groove with a rib 43 of the retaining device, on the one hand, with the lateral guide element having a maximum height 44, on the other hand. The groove and the rib extend along a direction parallel to a longitudinal axis of the ski.

The support force from the skier is better transmitted to the board when the lower end of the sole is in direct contact with the board 20, as shown in FIG. 1. This means that the height 15 of the groove in the sole should be at least be as great as, or in certain embodiments, greater than the height 44 of the lateral guide element.

For the guiding of the boot to be most effective, it is necessary to have a minimum overlap in height between the lateral guide element and the groove of the sole. The effective guiding length $L_G$ of the lateral guide element is defined as the length for which the overlap is sufficient. This effective guiding length is related to the maximum height 44. It begins and ends when the height of the rib exceeds a defined height 45, or predetermined height, along the length of the rib.

Specifically, in the non-limiting example shown, the height 45 is equal to one-third of the maximum height of the rib or, in another such example, greater than one-half the maximum height. The maximum height 44 of the rib should be at least greater than three millimeters.

The rib is not necessarily continuous. It can include transverse recesses that may be useful in facilitating the removal of snow and therefore to prevent the formation of ice on the lateral guide element that can disturb the support of the boot on the board, or in facilitating the bending of the lateral guide element in order to better conform to the shape of a cambered board when it is being attached thereto.

The guiding of the boot is directly related to the longitudinal position of the lateral guide element. For a good lateral guiding, the rear end 42 of the lateral guide element should be substantially aligned with the heel of the boot. In other words, the rear end $\mathbf{42}_G$ of the effective guiding length $L_G$ should coincide with the rear end of the groove in the boot sole.

There may be a slight offset in the alignment without significantly affecting the lateral guiding of the boot.

The longitudinal position of the lateral guide element is determined with respect to the retaining device, as it forms the articulation point of the boot and therefore determines the longitudinal positioning of the boot relative to the board. The longitudinal position of the lateral guide element is defined by a first positioning distance D1 separating the rear end 32 of the retaining device from the front end $\mathbf{41}_G$ of the effective guiding length $L_G$, and by the effective guiding length $L_G$. The first positioning distance D1 can be regarded as a reference distance between the position of the guide element and the retaining device, i.e., such reference distance could extend between the front end of the effective guiding length of the guide element and a point on the retaining device other than the rear end 32.

According to this first embodiment, the lateral guide element is affixed to the board using two screws 50*a*, 50*b* extending through respective holes 46*a*, 46*b* of the lateral guide element, and screwed into respective centering blind holes 22*a*, 22*b* drilled into the top surface 21 of the board, along an axis of revolution X22*a*, X22*b* perpendicular to the top surface 21.

Each through-hole 46*a*, 46*b* includes a tapered countersink in order to receive the head of the associated screw, which makes it possible to lay the lateral guide flat against the board.

Reference characters X46*a* and X46*b* designate the axes of the through-holes 46*a*, 46*b*, respectively. The centering holes have a center distance E. The through-holes have the same center distance E.

Reference character X1*p* designates the axis perpendicular to the top surface of the board and passes through the middle of the center distance E of the centering holes. $\mathbf{X1}_G$ designates the axis perpendicular to the surface 47 of the lateral guide element interfacing with the board and passes through the middle of the center distance E of the through-holes. When the lateral guide element is assembled to the board, the axes X1*p* and $\mathbf{X1}_G$ are merged, i.e., they are co-extensive.

According to this non-limiting embodiment, the positioning of the guide element is therefore dependent upon the positions of the centering holes 22*a*, 22*b*.

In practice, these centering holes are drilled using a template taking into account the dimensions of the lateral guide element, the boot size to be adjusted and the mechanisms for fixing the retaining device to the board. In the prior art, the drilled holes define a single positioning of the lateral guide element associated with a single boot size.

In the context of the invention, the screws 50*a*, 50*b* associated with the centering holes 22*a*, 22*b* form the first and second positioning mechanisms. Accordingly, the screws can be characterized as threaded positioning mechanisms. The through-holes 46*a*, 46*b* form the first and second complementary positioning mechanisms.

To obtain a double longitudinal positioning of the lateral guide element with the same positioning mechanisms, the through-holes 46*a*, 46*b* are arranged asymmetrically with respect to the center of the effective guiding length of the lateral guide element. This asymmetry can also be referred to as lengthwise asymmetry.

This asymmetry can result in a difference in length between the distance $\mathrm{D}\mathbf{41}_G$ separating one end $\mathbf{41}_G$ of the effective guiding length from the axis X46*a* of the through-hole 46*a* that is the closest to this end and the distance $\mathrm{D}\mathbf{42}_G$, separating the other end $\mathbf{42}_G$ of the effective guiding length from the axis X46*b* of the second through-hole 46*b*.

For example, the distance $\mathrm{D}\mathbf{41}_G$ is on the order of sixty millimeters, while the distance $\mathrm{D}\mathbf{42}_G$ is on the order of ten millimeters, the effective guiding length being on the order of one hundred and seventy millimeters (the center distance E is therefore on the order of one hundred millimeters). In this case, the ratio between these two distances $\mathrm{D}\mathbf{41}_G$, $\mathrm{D}\mathbf{42}_G$ is on the order of 15%. Advantageously, this ratio can vary between 10% and 30%.

This asymmetry can also result in the asymmetry of the ends of the effective guiding length relative to the axis $\mathbf{X1}_G$. Thus, one end $\mathbf{41}_G$ of the effective guiding length is spaced from the axis $\mathbf{X1}_G$ by a length $\mathrm{L}\mathbf{41}_G$, while the other end $\mathbf{42}_G$ is spaced from the same axis $\mathbf{X1}_G$ by a different length $\mathrm{L}\mathbf{42}_G$.

According to the same preceding example, the length $\mathrm{L}\mathbf{41}_G$ is on the order of one hundred and ten millimeters, while the length $\mathrm{L}\mathbf{42}_G$ is on the order of sixty millimeters, the effective guiding length being on the order of one hundred and seventy millimeters (the center distance E is still on the order of one hundred millimeters). In this case, the ratio between the two lengths $\mathrm{L}\mathbf{41}_G$, $\mathrm{L}\mathbf{42}_G$ is on the order of 55%. Advantageously, this ratio can vary between 50% and 75%.

Thus, due to this asymmetrical design, it is possible to obtain two longitudinal positions of the lateral guide element with the same lateral guide element and the same centering holes. Stated another way, with a single lateral guide element and a single pair of holes, the lateral guide element can be positioned selectively in either of two longitudinal positions.

To this end, it suffices to turn the lateral guide element around before assembly on the board. In other words, the lateral guide element is rotated 180° about the axis $\mathbf{X1}_G$. Then, the screws are screwed into the same two centering holes.

In this second position of the lateral guide element, i.e., with this second configuration of the lateral guide element and board, the end 42 of the lateral guide element becomes the front end and the end 41 becomes the rear end.

When the lateral guide element is assembled, the positioning distance D2 separating the rear end 32 of the retaining device from the new front end $\mathbf{42}_G$ of the effective guiding length $L_G$ differs from the positioning distance D1 relative to the first configuration.

Consequently, due to this difference in positioning distance, the rear position of the end $\mathbf{41}_G$ or $\mathbf{42}_G$ of the effective guiding length $L_G$ is different depending upon whether the guide is assembled according to a first configuration or to a second configuration corresponding to the reversal of the lateral guide.

As the rear position of the end 41G or 42G of the effective guiding length LG is determinant for guiding the heel of the boot, the first and second configurations correspond to different boot sizes.

Figure 2:
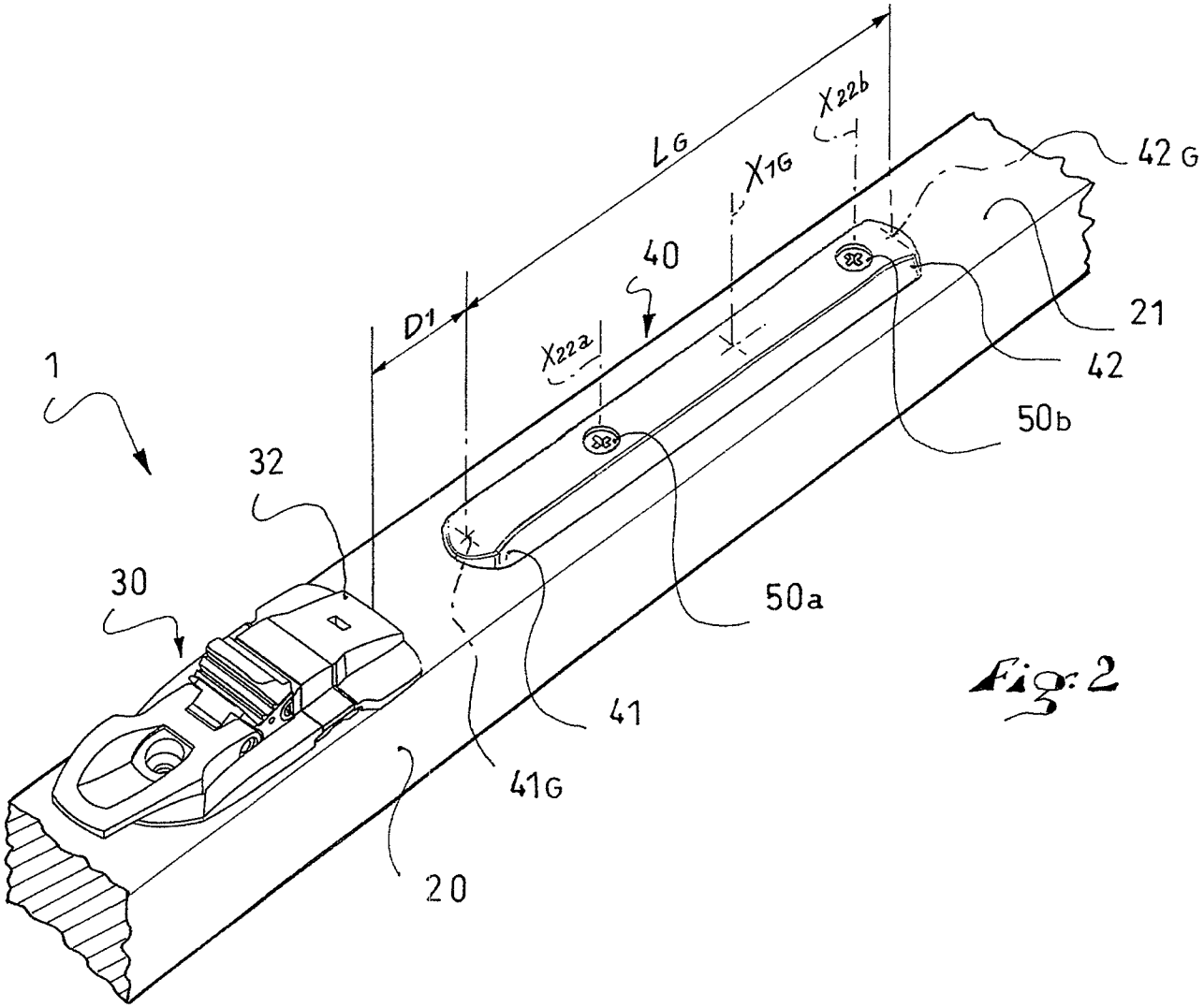
FIG. 2 is a partial perspective view of the sports article for which the lateral guide element is assembled at a first longitudinal position.

FIGS. 1 and 2 show the assembly of the lateral guide element according to a first configuration corresponding to a small boot size. The front screw 50*a* screwed into the centering hole 22*a* forms the first positioning mechanism cooperating with the through-hole 46*a* forming the first complementary positioning mechanism. Similarly, the rear screw 50*b* screwed into the centering hole 22*b* forms the second positioning mechanism cooperating with the through-hole 46*b* forms the second complementary positioning mechanism.

Figure 3:
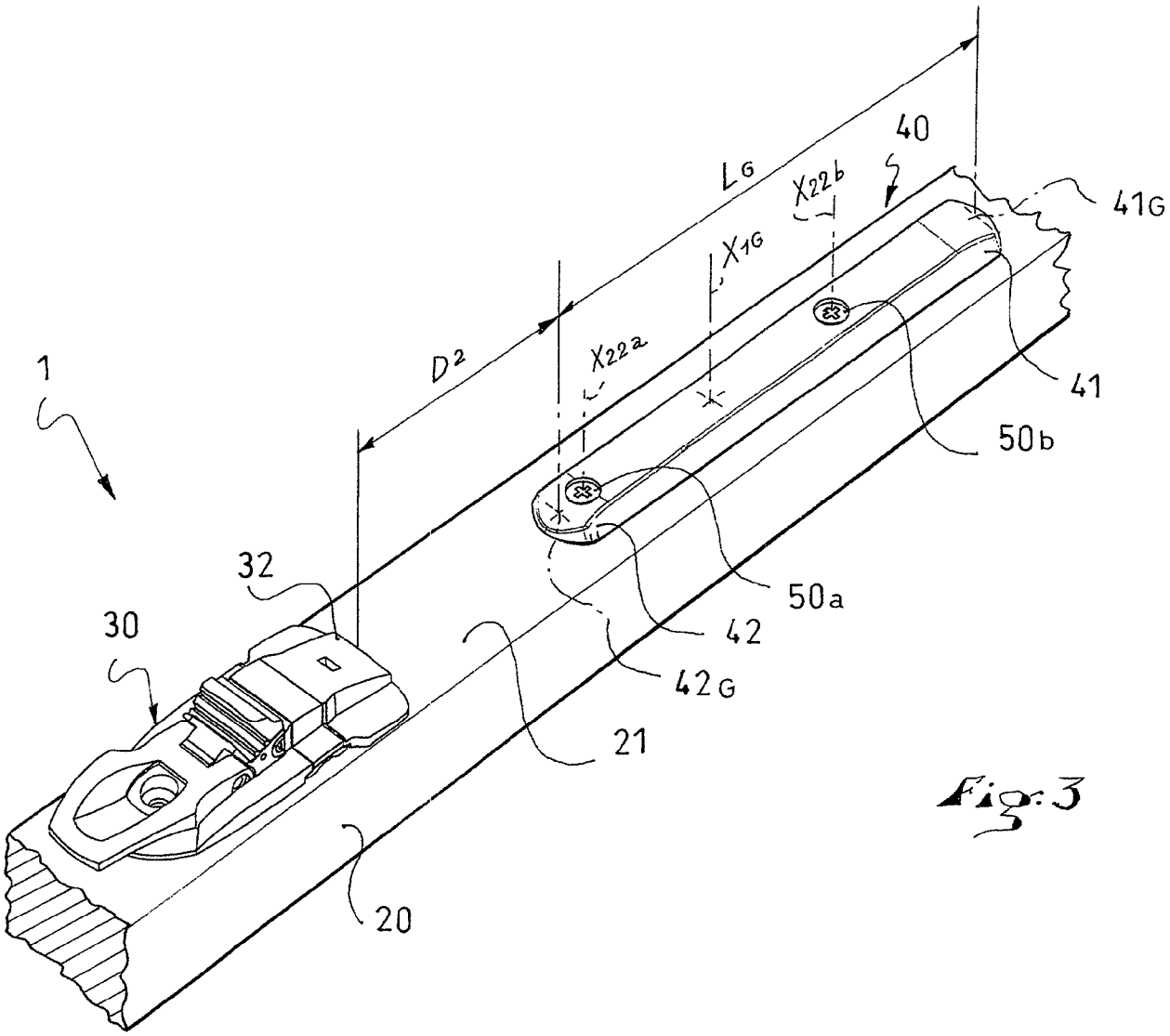
FIG. 3 is a partial perspective view of the sports article for which the lateral guide element is assembled at a second longitudinal position.

FIG. 3 shows the assembly of the reversed lateral guide, according to the second configuration corresponding to a larger boot size. In this case, the relationship between the positioning mechanisms and the complementary positioning mechanisms is reversed. Thus, the rear screw 50*a* screwed into the centering hole 22*a* cooperates with the through-hole 46*b*, while the rear screw 50*b* screwed into the centering hole 22*b* cooperates with the through-hole 46*a*.

According to this first embodiment, the first and second complementary positioning mechanisms cooperate with the first and second associated positioning mechanisms, respectively, of the sports apparatus when the lateral guide element is positioned according to the first configuration. Conversely, when the lateral guide element is positioned according to the second configuration, the first and second complementary positioning mechanisms cooperate with the second and first associated positioning mechanisms, respectively.

The adjustment of the two longitudinal positions is simple. To obtain the second longitudinal position, it suffices to reverse the lateral guide element and to make the complementary positioning mechanisms of the lateral guide element coincide with the associated positioning mechanisms of the sports apparatus. In other words, the associations of the positioning mechanisms/complementary positioning mechanisms are reversed.

The guiding zone of the lateral guide element is asymmetrical relative to the center of the complementary positioning mechanisms in order to obtain the two longitudinal positions of the lateral guide element from the same positioning mechanisms, namely, the first and second positioning mechanisms.

In this embodiment, the positioning mechanisms of the lateral guide element also make it possible to affix the lateral guide element to the board.

Similarly, the axes X1*p* and X1G are merged in the two configurations when the lateral guide element is assembled.

Figure 4:
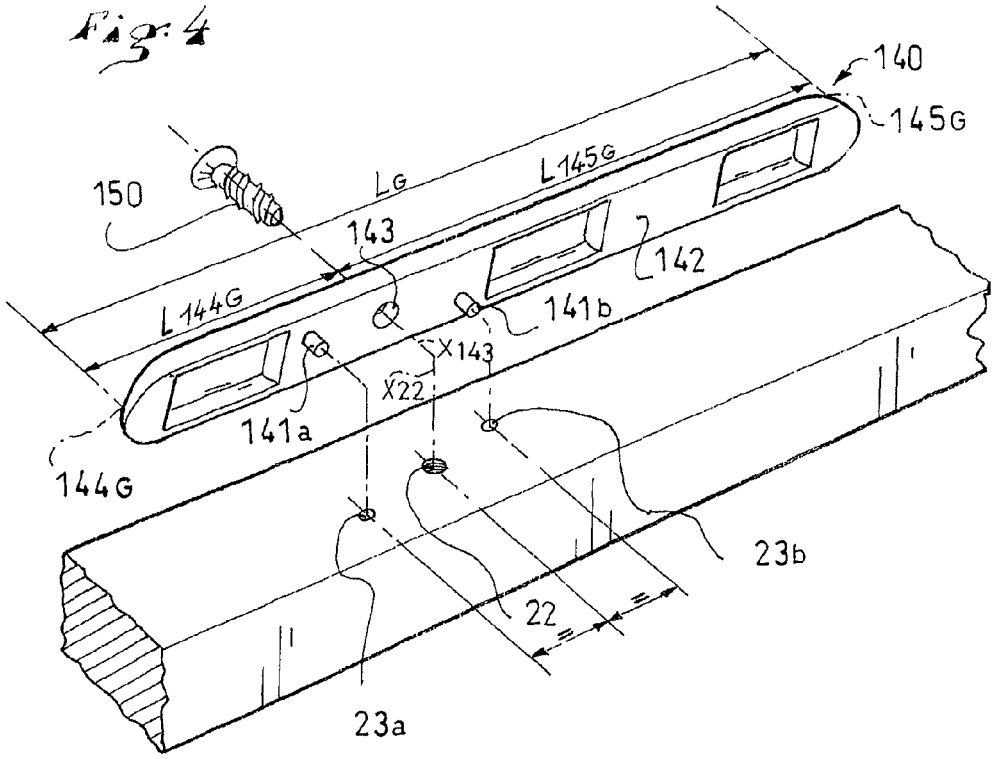
FIG. 4 is an exploded partial view of the sports article, according to a variation of the first embodiment of the invention.

FIG. 4 shows a variation of the first embodiment.

This solution has separate mechanisms for positioning or for affixing the lateral guide element relative to the board. The lateral guide element 140 includes two pins 141*a* and 141*b* projecting from the bottom surface 142 of the lateral guide element and forming the complementary positioning mechanisms.

Thus, the lateral guide element 140 is positioned via these two pins 141*a* and 141*b* (forming complementary positioning mechanisms) cooperating with two indexing holes 23*a* and 23*b*, the latter forming the associated positioning mechanisms of the board. The pins 141*a*, 141*b* and the holes 23*a*, 23*b* can be characterized as non-threaded positioning mechanisms, in contrast with the screws 50*a*, 50*b* and associated holes 22*a*, 22*b* of the embodiment of FIGS. 1-3.

The adjustment of the two longitudinal positions of the lateral guide element is similar to the first embodiment described hereinabove. The two pins replace the through-holes of the first embodiment and the indexing holes replace the screws/centering holes association.

The difference between the example of FIG. 4 and that of FIG. 1 lies in the affixing of the lateral guide element to the board. In FIG. 4, the guide element includes a through-hole 143 through which the screw 150 extends to become screwed into a centering hole 22 of the board. Unlike the embodiment of FIG. 1, only a single threaded positioning mechanism, including screw 150, is used.

The axis X143 of the through hole 143 passes through the center of the two pins. The axis X22 of the centering hole 22 passes through the center of the two indexing holes. The two axes X143 and X22 are merged in the two configurations when the lateral guide element is assembled.

The second configuration corresponds to a 180° rotation of the lateral guide element about the axis X143.

The lateral guide element is asymmetric with respect to the axis X143. Thus, one end 144G of the effective guiding length is distant by a length $L_{144G}$ from the axis X143, while the other end 145G is distant by a different length L145G from the same axis X143.

Alternatively, the number of pins and indexing holes may vary. In this case, the indexing holes must be arranged symmetrically with respect to the axis X22.

Figure 5:
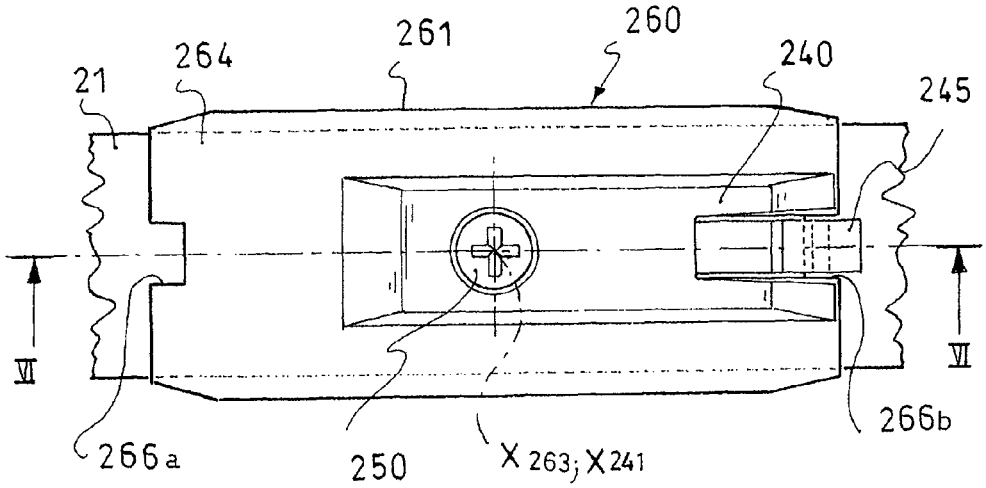
FIG. 5 is a top view of the sports article according to a second embodiment of the invention.
Figure 6:
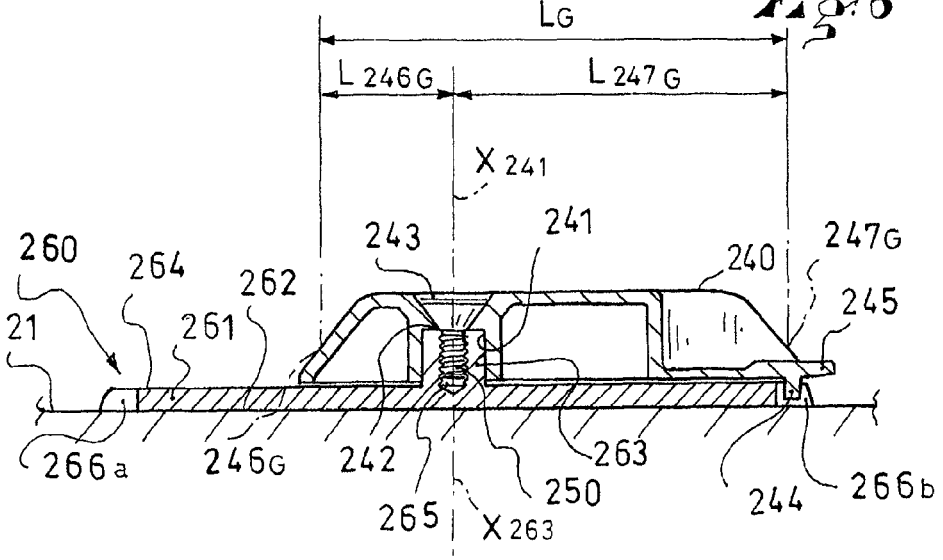
FIG. 6 is a cross-sectional view along the line VI-VI of FIG. 5.

FIGS. 5 and 6 illustrate a second embodiment.

This solution includes a baseplate 260 affixed to the board. The baseplate forms a plate 261, the bottom surface 262 of which is in contact with the top surface 21 of the board.

The assembly between these two elements is conventional. Such connection can be accomplished by means of screws or by means of an adhesive bond.

A barrel 263 projects from the top surface 264 of the plate 261 and extends along an axis X263 perpendicular to the bottom surface 262. The barrel 263 cooperates with a housing 241 of a lateral guide element 240 to enable the rotation of the lateral guide element about an axis of revolution X241 of the housing 241. In this regard, as shown in FIG. 6, the barrel 263 and the housing 241 have respective mating cylindrical surfaces extending perpendicularly from the surface 264 of the plate. When the lateral guide element is assembled with the baseplate, the axes X241 and X263 are merged.

To keep the lateral guide element assembled with the baseplate, a screw 250 extends through a through-hole 242 of the lateral guide element and is screwed into a centering hole 265 centered in the barrel 263. The head of the screw 250 is housed in a housing 243 of the lateral guide element so as to block the separation of the lateral guide element from the baseplate.

The lateral guide element 240 is pivotally mounted about an axis X241 of the baseplate 260.

To guide the boot laterally, it is necessary to block the rotation of the guide element so as to align the effective guiding length of the lateral guide element along a longitudinal axis of the board.

In this case, the rotational blocking is obtained through cooperation of depending tang 244, i.e., a downwardly projecting tang, at the end of a clip 245 forming an end of the lateral guide element with a notch 266*a* or 266*b* of the plate 261. The clip and the notches are dimensioned and arranged so that, when they cooperate, the effective guiding length of the lateral guide element is aligned with a longitudinal axis of the board. The notches 266*a*, 266*b* are symmetrical relative to the axis X263.

The lateral guide element can take two stable positions. In a first configuration, the clip cooperates with the rear notch 266*b*. The second configuration corresponds to a 180° rotation of the lateral guide element about the axis X241. Only a single threaded element, screw 250, is used.

As with the previous embodiments, the lateral guide element 240 is asymmetrical with respect to the axis X241. Thus, one end 246G of the effective guiding length is spaced from the axis X241 by a length L246G, while the other end 247G is spaced from the same axis X241 by a different length L247G.

The ratio between these lengths L246G and L247G is advantageously on the same order as previously, between 50% and 75%.

To improve the rotational immobilization, the screw 250 can also be used. By turning the screw slightly farther into the barrel, the guide element can be pressed flat against the baseplate, in the area of the barrel or on the top surface of the plate. This frictional contact can contribute to the rotational blocking of the lateral guide element.

For this embodiment, the barrel 263 forming the first positioning mechanism of the board cooperates with the housing 241 forming the first complementary positioning mechanism. Similarly, a notch 266*a* or 266*b*, forming a second positioning mechanism of the board, cooperates with the tang 244 of the clip 245 forming the second complementary positioning mechanism. In this case, the two positions of the lateral guide element 240 are obtained with the same cooperation between the first positioning mechanism and the first complementary positioning mechanism.

According to this second embodiment, the lateral guide element is provided with a first complementary positioning mechanism cooperating with a first associated positioning mechanism so as to guide the lateral guide element rotationally about an axis of rotation perpendicular to the top surface of the sports apparatus, and a second complementary positioning mechanism cooperating with a second or third associated positioning mechanism so as to block the rotation of the lateral guide element about the axis of rotation.

This solution facilitates the adjustment between the two adjustable longitudinal positions because only a turn of the guide element around a pivot connection is required. The longitudinal positioning of the lateral guide element depends upon the angular position of the lateral guide element relative to the sports apparatus.

Thus, the longitudinal positioning is determined by the guiding formed by the association of the first complementary positioning mechanism with the first associated positioning mechanism, on the one hand, and by the indexation formed by the association of the second complementary positioning mechanism with another associated positioning mechanism.

The guiding zone of the lateral guide element is asymmetrical with respect to the axis of rotation, which makes it possible to obtain two different longitudinal positions for the lateral guide element from the same positioning mechanism, namely, the first positioning mechanism.

Obtaining the pivot connection, as well as the rotational blocking of the lateral guide element is not limited to the embodiment of FIGS. 5 and 6. The invention encompasses other structures and embodiments for these functions.

Figure 7:
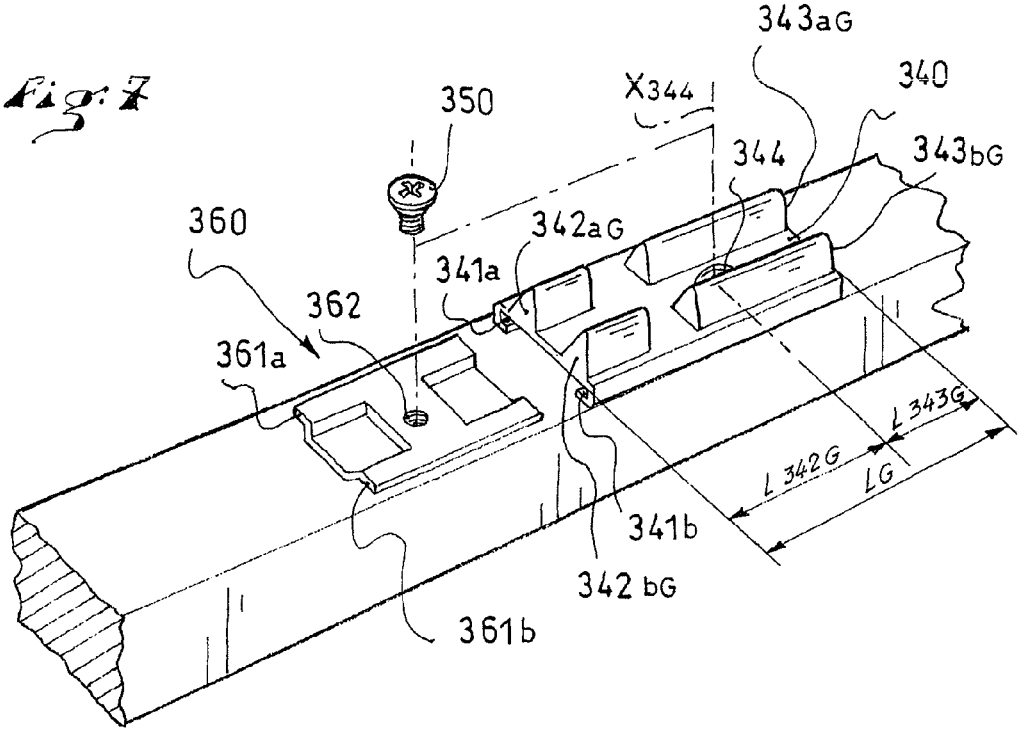
FIG. 7 is an exploded partial view of the sports article according to the third embodiment of the invention.

FIG. 7 shows a third embodiment.

This embodiment includes a baseplate 360 affixed to the board using conventional means, such as screws or glue. The baseplate comprises two edges 361*a*, 361*b* extending laterally and parallel to a longitudinal axis of the board. These edges 361*a*, 361*b* cooperate with grooves 341*a*, 341*b* of a lateral guide element 340 so as not to allow a longitudinal translation of the lateral guide element along a longitudinal axis of the board. The baseplate thus forms a rail for the lateral guide element.

It is necessary to block the translation of the lateral guide element in order to position the lateral guide element longitudinally, In this case, the translational blocking is achieved by a screw 350 extending through a through-hole 344 of the lateral guide element having an axis X344 and screwed into a threaded hole 362 of the baseplate.

The lateral guide element can therefore be assembled selectively according to either of two configurations, the second configuration corresponding to a 180° rotation of the lateral guide element about the axis X344.

In this embodiment, the boot is guided by two parallel ribs extending along a direction parallel to a longitudinal axis of the board. There are then two effective guiding lengths. The invention operates similarly to the previously described embodiments.

As with the previously described embodiments, the lateral guide element is asymmetrical with respect to the axis X344. Thus, one end 342*a*G or 342*b*G of the effective guiding length is distant by a length L342G from the axis X344, while the other end 343*b*G or 343*a*G is distant by a different length $L_{343G}$ from the same axis X344. As shown in FIG. 7, the ribs may be discontinuous.

For this embodiment, the edges 361*a*, 361*b* forming the first positioning mechanism cooperate with the grooves 341*a*, 341*b* forming the first complementary positioning mechanism. Similarly, the screw 350 screwed into the baseplate 360 forming a second positioning mechanism cooperates with the through-hole 344 forming the second complementary positioning mechanism. In this case, the two positions of the lateral guide element are obtained with the same cooperation between the second positioning mechanism and the second complementary positioning mechanism.

According to this third embodiment of FIG. 7, the lateral guide element is provided with a first complementary positioning mechanism cooperating with a first associated positioning mechanism so as to guide the displacement of the lateral guide element along a longitudinal translational axis of the sports apparatus, and a second complementary positioning mechanism cooperating with a second associated positioning mechanism so as to block the displacement of the lateral guide element along the translational axis.

This embodiment is also simple to assemble.

The longitudinal positioning of the lateral guide element is mainly determined by the translational blocking, that is to say, by the association of the second complementary positioning mechanism with the second associated positioning mechanism.

The guiding zone of the lateral guide element is asymmetrical with respect to the second complementary positioning mechanism, which makes it possible to obtain two different longitudinal positions for the lateral guide element from the same positioning mechanism, namely, the second positioning mechanism.

Obtaining the sliding connection, as well as the translational blocking of the lateral guide element is not limited to the embodiment described in FIG. 7. The invention encompasses other structures and embodiments for these functions. For example, the translational blocking can be achieved using a clip.

The positioning mechanism may not be integral with the sports apparatus. It may be integral with an element affixed to the sports apparatus, as is the case in the second and third embodiments.

Like the embodiments of FIG. 4, FIGS. 5-6, and FIG. 7, the lateral guide element 340 includes a complementary positioning mechanism that includes a structure, here in the form of a pair of grooved guides 341*a*, 341*b*, that extends toward the top surface of the sports apparatus, when affixed to the sports apparatus, to a lowermost extent of the lateral guide element. In FIG. 4, such structure includes the downwardly extending pins 141*a*, 141*b*. In FIGS. 5-6, such structure includes the downwardly depending tang 244.

The invention is not limited to the particular embodiments described above and includes other alternative structures and embodiments. Similarly, the technical solutions of the various embodiments can be combined. For example, screws can be replaced with clips, or vice versa.

Furthermore, the functions of the previously described baseplates can be integrated directly into the top surface of the board, such as unitary, and such as by overmolding or otherwise. The board can also have a plurality of sets of positioning mechanisms distributed along the board in order to increase the number of possibilities for adjusting the longitudinal position of the lateral guide element, each set of positioning mechanisms corresponding to two possible configurations for the assembly of the lateral guide element.

The lateral guide element can be attached directly to the ski and independently of the retaining device. Because these two elements are separated, they contribute less to stiffening the ski. The space between the two elements enables the board to bend. The lateral guide element and the retaining device are therefore easier to assemble on a cambered ski, without disturbing its characteristics.

Advantageously, the complementary positioning mechanism in the embodiments of the invention is arranged longitudinally between the two longitudinal ends of the lateral zone of the lateral guide element for guiding the rear portion of the boot. This guiding zone corresponds to the effective guiding length LG. Such an arrangement enables the lateral guide element to be made compact. In addition, it makes it possible to position the rear guiding as close to the rib supporting the retaining device as possible. Continuous guiding can thus be obtained between the retaining device and the lateral guide element.

The invention relates to the sports apparatus, such as the previously described cross-country ski, to the binding incorporating such a lateral guide element, and to the lateral guide element structured and arranged for use with the binding. According to other embodiments:

The guiding zone (LG) of the lateral guide element (40, 140, 240, 340) is asymmetrical with respect to the axis of rotation (X1G, X143, X241, X344) considered for switching between the two positions.

The lateral guide element (40, 140, 240, 340) includes a single central rib.

The complementary positioning mechanism of the lateral guide element (240) is a projecting shape (244) or a housing forming the end of an elastic lug (245), and the associated positioning mechanism is a housing (266*a*, 266*b*) or a projecting shape capable of cooperating with the end (244) of the elastic lug (245).

The sports apparatus (20) includes a plurality of positioning mechanisms (22*a*, 22*b*, 23*a*, 23*b*, 362) enabling a plurality of double longitudinal positions of the lateral guide element.

The lateral guide element (40, 140, 240) is affixed directly to the sports apparatus (20), independently of a device (30) for retaining the boot.

In addition to the foregoing, the invention disclosed herein by way of exemplary embodiments suitably may be practiced in the absence of any element or structure which is not specifically disclosed herein.

The invention claimed is:

1. A sports article adapted to cooperate with a boot, said sports article comprising:

a sports apparatus comprising at least one positioning mechanism;

a lateral guide element for cooperation with a rear portion of the boot, the lateral guide element being structured and arranged to be affixed to a top surface of the sports apparatus, the lateral guide element comprising:

at least one complementary positioning mechanism cooperating with the at least one positioning mechanism of the sports apparatus, the at least one positioning mechanism of the sports apparatus constituting at least one associated positioning mechanism, in order to re-position the lateral guide element on the sports apparatus;

one of the at least one complementary positioning mechanism being structured and arranged to facilitate a selective longitudinal positioning of the lateral guide element on the sports apparatus in either of a first longitudinal position and a second longitudinal position by cooperating with a single one of the at least one said associated positioning mechanism, the lateral guide element being structured and arranged to cooperate with, and to guide, a rear portion of the boot in both of the first and second longitudinal positions;

the second longitudinal position of the lateral guide element constituting a 180° rotation of the lateral guide element in relation to an axis of rotation perpendicular to the top surface of the sports apparatus with respect to the first longitudinal position of the lateral guide element; and a guiding zone that is lengthwise asymmetrical with respect to the axis of rotation for movement between the first and second positions;

the guiding zone having an effective guiding length extending between a first end and a second end;

a distance between the first end and the axis of rotation being a shorter length, and a distance between the second end and the axis of rotation being a longer length;

a ratio between the shorter length and the longer length being between 50% and 75%.

2. A sports article according to claim 1, wherein:

the lateral guide element includes a first complementary positioning mechanism and a second complementary positioning mechanism;

in the first longitudinal position of the lateral guide element, the first and second complementary positioning mechanisms cooperate with the first and second associated positioning mechanisms, respectively;

in the second longitudinal position of the lateral guide element, the first and second complementary positioning mechanisms cooperate with the second and first associated positioning mechanisms, respectively.

3. A sports article according to claim 1, wherein:

the lateral guide element includes a first complementary positioning mechanism of the at least one complementary positioning mechanism cooperating with a first associated positioning mechanism of the at least one associated positioning mechanism structured and arranged to guide the lateral guide element rotationally about the axis of rotation and a second complementary positioning mechanism of the at least one complementary positioning mechanism cooperating with a second or third associated positioning mechanism of the at least one associated positioning mechanism structured and arranged to block the rotation of the lateral guide element about the axis of rotation.

4. A sports article according to claim 1, wherein:

the lateral guide element includes a first complementary positioning mechanism of the at least one complementary positioning mechanism cooperating with a first associated positioning mechanism of the at least one associated positioning mechanism structured and arranged to guide the displacement of the lateral guide element along a longitudinal axis of translation of the sports apparatus and a second complementary positioning mechanism of the at least one complementary positioning mechanism cooperating with a second associated positioning mechanism of the at least one associated positioning mechanism structured and arranged to block the displacement of the lateral guide element along the axis of translation.

5. A sports article according to claim 1, wherein:

at least one of the following is structured and arranged to affix the lateral guide element to the sports apparatus:

the at least one positioning mechanism; and the at least one complementary positioning mechanism.

6. A sports apparatus according to claim 1, wherein:

the at least one complementary positioning mechanism of the lateral guide element is a hole extending through the lateral guide element for receiving a screw forming the at least one associated positioning mechanism, the screw constructed and arranged to be affixed to the sports apparatus.

7. A sports article according to claim 1, further comprising:

a baseplate structured and arranged to be attached onto the sports apparatus;

the positioning mechanism is structured and arranged to be affixed to the baseplate.

8. A sports article according to claim 1, wherein:

the at least one associated positioning mechanism of the sports apparatus comprises at least one non-threaded positioning mechanism.

9. A sports article according to claim 1, wherein:

the at least one complementary positioning mechanism comprises at least one non-threaded element projecting toward the top surface of the sports apparatus when affixed to the sports apparatus, said non-threaded element constituting a lowermost extent of the lateral guide element.

10. A sports article according to claim 3, wherein:

the second complementary positioning mechanism comprises a depending tang at an end of the lateral guide element.

11. A binding assembly for connecting a boot to a sports apparatus, the binding assembly comprising:

a binding structured and arranged to connect the boot to the sports apparatus while allowing a heel of the boot to move toward and away from a top surface of the sports apparatus during use;

a lateral guide element for cooperation with a rear portion of the boot, the lateral guide element being structured and arranged to be affixed to the top surface of the sports apparatus, the lateral guide element comprising:

at least one complementary positioning mechanism cooperating with an associated positioning mechanism of the sports apparatus in order to re-position the lateral guide element on the sports apparatus;

the complementary positioning mechanism being structured and arranged to facilitate a selective longitudinal positioning of the lateral guide element on the sports apparatus in either of a first longitudinal position and a second longitudinal position by cooperating with a single one of the at least one said associated positioning mechanism;

the second longitudinal position of the lateral guide element constituting a 180° rotation of the lateral guide element in relation to an axis of rotation perpendicular to the top surface of the sports apparatus with respect to the first longitudinal position of the lateral guide element;

in the first longitudinal position a reference distance longitudinally separates a more-forward end of two longitudinally spaced-apart ends of the lateral guide element from the binding; and in the second longitudinal position a distance greater than the reference distance longitudinally separates the more-forward end of the lateral guide element from the binding.

12. A binding assembly according to claim 11, wherein:

the guide element further comprises:

a guiding zone that is lengthwise asymmetrical with respect to the axis of rotation for movement between the first and second positions;

the guiding zone having an effective guiding length extending between a first end and a second end;

a distance between the first end and the axis of rotation being a shorter length, and a distance between the second end and the axis of rotation being a longer length;

a ratio between the shorter length and the longer length being between 50% and 75%.

13. A binding assembly according to claim 11, wherein:

the at least one complementary positioning mechanism comprises at least one non-threaded element projecting toward the top surface of the sports apparatus, when affixed to the sports apparatus, to a lowermost extent of the lateral guide element.

14. A lateral guide element for guiding a rear portion of a boot, the lateral guide element being structured and arranged to be affixed to a top surface of a sports apparatus, said lateral guide element comprising:

at least one complementary positioning mechanism cooperating with an associated positioning mechanism of the sports apparatus in order to re-position the lateral guide element on the sports apparatus;

the complementary positioning mechanism being structured and arranged to facilitate a selective longitudinal positioning of the lateral guide element on the sports apparatus in either of a first longitudinal position and a second longitudinal position by cooperating with a single said associated positioning mechanism;

the second longitudinal position of the lateral guide element constituting a 180° rotation of the lateral guide element in relation to an axis of rotation perpendicular to the top surface of the sports apparatus with respect to the first longitudinal position of the lateral guide element;

a guiding zone that is lengthwise asymmetrical with respect to the axis of rotation for movement between the first and second positions;

the guiding zone having an effective guiding length extending between a first end and a second end;

a distance between the first end and the axis of rotation being a shorter length, and a distance between the second end and the axis of rotation being a longer length;

a ratio between the shorter length and the longer length being between 50% and 75%.

15. A lateral guide element for guiding a rear portion of a boot, the lateral guide element being structured and arranged to be affixed to a top surface of a sports apparatus, said lateral guide element comprising:

at least one complementary positioning mechanism cooperating with an associated positioning mechanism of the sports apparatus in order to re-position the lateral guide element on the sports apparatus;

the complementary positioning mechanism being structured and arranged to facilitate a selective longitudinal positioning of the lateral guide element on the sports apparatus in either of a first longitudinal position and a second longitudinal position by cooperating with a single said associated positioning mechanism;

the second longitudinal position of the lateral guide element constituting a 180° rotation of the lateral guide element in relation to an axis of rotation perpendicular to the top surface of the sports apparatus with respect to the first longitudinal position of the lateral guide element;

the at least one complementary positioning mechanism comprises at least one non-threaded element projecting toward the top surface of the sports apparatus, when affixed to the sports apparatus, to a lowermost extent of the lateral guide element;

the at least one non-threaded element comprising a pair of longitudinally spaced-apart pins.

16. A lateral guide element for guiding a rear portion of a boot, the lateral guide element being structured and arranged to be affixed to a top surface of a sports apparatus, said lateral guide element comprising:

at least one complementary positioning mechanism cooperating with an associated positioning mechanism of the sports apparatus in order to re-position the lateral guide element on the sports apparatus;

the complementary positioning mechanism being structured and arranged to facilitate a selective longitudinal positioning of the lateral guide element on the sports apparatus in either of a first longitudinal position and a second longitudinal position by cooperating with a single said associated positioning mechanism;

the second longitudinal position of the lateral guide element constituting a 180° rotation of the lateral guide element in relation to an axis of rotation perpendicular to the top surface of the sports apparatus with respect to the first longitudinal position of the lateral guide element;

the at least one complementary positioning mechanism comprises at least one non-threaded element projecting toward the top surface of the sports apparatus, when affixed to the sports apparatus, to a lowermost extent of the lateral guide element;

the at least one non-threaded element comprising a depending tang at an end of the lateral guide element.

17. A lateral guide element for guiding a rear portion of a boot, the lateral guide element being structured and arranged to be affixed to a top surface of a sports apparatus, said lateral guide element comprising:

at least one complementary positioning mechanism cooperating with an associated positioning mechanism of the sports apparatus in order to re-position the lateral guide element on the sports apparatus;

the complementary positioning mechanism being structured and arranged to facilitate a selective longitudinal positioning of the lateral guide element on the sports apparatus in either of a first longitudinal position and a second longitudinal position by cooperating with a single said associated positioning mechanism;

the second longitudinal position of the lateral guide element constituting a 180° rotation of the lateral guide element in relation to an axis of rotation perpendicular to the top surface of the sports apparatus with respect to the first longitudinal position of the lateral guide element;

the at least one complementary positioning mechanism comprises at least one non-threaded element projecting toward the top surface of the sports apparatus, when affixed to the sports apparatus, to a lowermost extent of the lateral guide element;

the at least one non-threaded element comprising a pair of transversely spaced-apart grooved guides.

* * * * *